US009295314B2

(12) United States Patent
McClees

(10) Patent No.: US 9,295,314 B2
(45) Date of Patent: Mar. 29, 2016

(54) CONTAINER WITH FLEXIBLE ATTACHMENT MECHANISM AND METHOD OF USE

(76) Inventor: David McClees, Falmouth, ME (US)

( * ) Notice: Subject to any disclaimer, the term of this patent is extended or adjusted under 35 U.S.C. 154(b) by 192 days.

(21) Appl. No.: 13/252,158

(22) Filed: Oct. 3, 2011

(65) Prior Publication Data

US 2012/0080440 A1 Apr. 5, 2012

Related U.S. Application Data

(60) Provisional application No. 61/389,504, filed on Oct. 4, 2010.

(51) Int. Cl.

| | |
|---|---|
| ***B65D 81/00*** | (2006.01) |
| ***A45C 13/30*** | (2006.01) |
| ***A45C 1/02*** | (2006.01) |
| ***A45C 3/00*** | (2006.01) |
| ***A45C 13/26*** | (2006.01) |
| *A45C 11/00* | (2006.01) |

(52) U.S. Cl.

CPC ..... *A45C 13/30* (2013.01); *A45C 1/024* (2013.01); *A45C 3/001* (2013.01); *A45C 13/26* (2013.01); *A45C 2011/002* (2013.01); *A45C 2013/306* (2013.01)

(58) Field of Classification Search

CPC ..... B65D 81/00; A45C 1/024; A45C 13/26; A45C 13/30; A45C 3/001

USPC ..... 220/475, 751, 524, 694, 735, 737, 740, 220/23.83, 23.86; 206/279, 289, 335; 248/104

See application file for complete search history.

(56) References Cited

U.S. PATENT DOCUMENTS

| | | | | |
|---|---|---|---|---|
| 1,786,459 | A * | 12/1930 | Simons | 248/104 |
| 4,114,847 | A * | 9/1978 | Bogensberger | 248/104 |
| 5,092,682 | A | 3/1992 | Fenick | |
| 5,385,500 | A * | 1/1995 | Schmidt | 446/73 |
| 5,407,111 | A | 4/1995 | Lanouette | |
| 5,813,584 | A | 9/1998 | Mauser | |
| 5,853,212 | A | 12/1998 | Daniel | |
| 5,957,357 | A | 9/1999 | Kallman | |
| 6,113,170 | A | 9/2000 | Daniel | |
| RE38,897 | E | 11/2005 | Krenzel | |
| 7,192,069 | B1 | 3/2007 | Daniel | |
| 7,341,296 | B2 | 3/2008 | Daniel | |
| 7,458,623 | B2 | 12/2008 | Daniel | |
| 7,469,946 | B2 | 12/2008 | Daniel | |
| 7,568,670 | B2 | 8/2009 | Wang | |
| 7,673,919 | B2 | 3/2010 | Daniel | |
| 7,887,082 | B2 | 2/2011 | Caslowitz | |

(Continued)

*Primary Examiner* — Fenn Mathew
*Assistant Examiner* — Elizabeth Volz
(74) *Attorney, Agent, or Firm* — Tredecim LLC; Sean L. Sweeney

(57) ABSTRACT

The present invention is direct to an item holding device having a container body and a flexible tail and method of use. The flexible tail, which is repositionable when sufficient force is applied, yet allows the invention to be reasonably fixed once configured, allows a user to attach the item holding device in locations unsuitable for traditional fastening mechanisms. The flexible tail facilitates the positioning of the item holding device within convenient reach of the user by enabling the user to wrap the flexible tail around a static structure or configure it to form a support stand for placement upon a surface. The flexible nature of the tail allows the tail to snugly conform to the shape of the attachment point, keeping the item holding device securely in place.

20 Claims, 9 Drawing Sheets

(56) References Cited

U.S. PATENT DOCUMENTS

| | | | | |
|---|---|---|---|---|
| 2001/0048409 | A1* | 12/2001 | Kim | 345/82 |
| 2003/0218105 | A1* | 11/2003 | Sones et al. | 248/104 |
| 2008/0066264 | A1 | 3/2008 | Daniel | |
| 2008/0067823 | A1 | 3/2008 | Daniel | |
| 2008/0272259 | A1 | 11/2008 | Zavattieri | |
| 2009/0014611 | A1 | 1/2009 | Hampton | |
| 2009/0050767 | A1 | 2/2009 | Stone | |
| 2009/0152228 | A1* | 6/2009 | McCaskill | 215/11.6 |
| 2009/0202960 | A1* | 8/2009 | White et al. | 433/77 |
| 2009/0266961 | A1 | 10/2009 | Lewis | |

* cited by examiner

CONTAINER WITH FLEXIBLE ATTACHMENT MECHANISM AND METHOD OF USE

CROSS-REFERENCE TO RELATED APPLICATION

This application claims priority from U.S. Provisional Patent Application Ser. No. 61/389,504, filed Oct. 4, 2010, the disclosure of which is herein incorporated by reference.

BACKGROUND

1. Field of the Invention

The present invention pertains to the field of item holding devices. Specifically, this invention relates to a novel device and method of use for an item holding device that may be attached to, or set upon, a wide variety of structures, objects, and surfaces allowing items to be within easy reach of the user.

2. Discussion of Background Information

One of the realities of modern life is the proliferation of items that individuals utilize in their daily routine. Whether electronic devices, such as cell phones or PDAs, writing instruments, toiletry items or other small personal items, keeping these totable items conveniently within reach can be a cumbersome task. Often an individual will store these items in one container, place them in another container or seal them in a carrying device for transport, and then transfer the items a third time when it is time to access and use them.

The art of binding containers, bags, and other holding devices to structures, objects, and surfaces has been widely explored. Many pouches, bags, and receptacles are provided with straps, hook and loop fasteners, clips, clamps, suction cups, rigid wire hooks, etc. allowing them to be secured or positioned. The primary purpose of these attachable devices is to provide a convenient means for positioning desired items within easy reach of the user. Despite the fact that there are many such devices known in the art, most devices are limited in what they can be affixed to because of the mechanism used for attaching the device.

While rigid hooks may provide a means for attaching holding devices, this type of mechanism is typically limited to hanging from objects of specific proportions, such as when a hook is used on a horizontal bar in a closet or shower. Similarly, clips have also been employed as a means of fixing a receptacle, but a clip can only be hooked onto a limited range of appropriately sized structures, thereby limiting its usefulness. Additionally, connections made using clips and buckles require dexterity, which may limit the utility of those holding devices for certain groups of people.

Another popular means of fixing a holding device known in the art is the suction cup. While a suction cup fastener may allow a container to stay in position, it requires a smooth, flat, clean surface to adhere, thereby limiting the positionability and usefulness of the device. Other prior art devices utilize hook and loop closures, which allow more attachment options. However, such fasteners will often stick to unwanted surfaces, and have difficulty maintaining position on vertical structures, such as the posts of a bed frame.

Flexible shaft technology has been used with many operative components, including flashlights and lamps, small mirrors, toys, and navigation devices. In the majority of applications, the flexible shaft serves as a positioning neck, which combines the base or attachment mechanism of the device to the functional part. For example, U.S. patent app. 2003/0218105 to Sones discloses a device for holding baby accessories, comprising a magnetic end connected to a clamp by means of a flexible shaft. The flexible shaft serves only a positioning function rather than a means of fixing the device to a structure. The device is stabilized by a clamp, which limits the utility because it can only be attached to objects that fit within the jaws of the clamp. Additionally, the device requires magnetic accessories to function.

Flexible arm technology has also been implemented to assist photographers with the secure positioning of a camera. For example, U.S. Pat. No. 7,891,615 to Bevirt discloses a tripod possessing flexible legs consisting of a series of ball and socket joints that are attached into a camera mount. The tripod is designed to attach to a wide variety of items and hold a camera securely during operation. In operation, a camera must be positioned in a precise manner based on the location of the subject. In addition, it is often necessary to hold the camera remarkably steady to avoid photographic blurring. The flexible tripod disclosed by Bivert achieves these goals by disclosing a tripod that possesses multiple legs, which each include a number of ball and socket joints to provide flexibility. These ball and socket joints require sophisticated machining to produce and have a limited range of motion. As a result, the tripod often requires the use of all three legs to secure a camera in a given location. For example, in situations where the attachment point is a thin item, such as a shower head pipe, the neck of a lamp, etc., it can be quite difficult to adequately secure the tripod since the ball and socket joints do not possess the range of motion required to securely wrap around the item. In addition, when flexible attachment points are involved, such as straps on bags or backpacks, the ball and socket legs can interfere with the function of the bag since they are frequently more rigid than the strap they are attaching to, often deforming the strap once a connection is made and thereby compromising the function of the bag or backpack. Finally, in contrast to the art of tripods, the art of item holding devices is often concerned with aesthetics and fashion and flexible legs utilizing ball and socket joints are simply impractical in situations where users demand a sleek stylish means of attaching their holding device.

None of the above inventions, taken either singly or in combination, adequately address or resolve the aforementioned problems. Therefore, a need exists for an item holding device and method that may be attached to, or set upon, a wide variety of structures, objects, and surfaces allowing items to be within easy reach of the user.

SUMMARY OF THE INVENTION

The present invention solves the problems associated with carrying and positioning small articles and other totable items and provides a device and method for holding, transporting and positioning items within easy reach of the user in a wide variety of environments.

The present invention is directed to an item holding device that allows the user to easily attach the device to a wide variety of items or to position the device on a wide variety of surfaces. The item holding device comprises a container and a flexible tail. The flexible tail is sufficiently flexible to allow repositioning by the user when sufficient pressure is applied, yet rigid enough to maintain its shape once the desired configuration is achieved. The flexible tail can engage with a structure, such as a post, a railing, a lamp shaft, a showerhead pipe or a rearview mirror in an automobile. Similarly, the flexible tail can easily be configured to securely engage with any handle or strap on a bag or backpack to facilitate transportation of the device within easy reach of the user. Further, the flexible tail can be configured in a manner that provides a stand, precisely adapted to the surface where the user wants to place the item holder.

The present invention is also directed to a method for using an item holding device. First, the method comprises providing an item holding device comprising a container and a flexible tail. The flexible tail is sufficiently flexible to allow repositioning by the user when sufficient pressure is applied, yet rigid enough to maintain its shape once the desired configuration is achieved. The method further comprises engaging the item holding device with a structure, such as a post, a railing, a lamp shaft, a showerhead pipe or a rearview mirror in an automobile or to securely engage with any handle or strap on a bag or backpack. To engage the structure, handle or strap, the flexible tail is wrapped around said structure in a manner that utilizes frictional forces to maintain the position of the device within easy reach of the user. Once engaged with the structure, the item holding device can be precisely positioned by adjusting the angle of the container body.

The present invention is also directed to a method of for using an item holder that comprises providing an item holding device comprising a container and a flexible tail, wherein the flexible tail is sufficiently flexible to allow repositioning when sufficient pressure is applied, yet rigid enough to maintain its shape one the desired configuration is achieved. The method further comprises configuring the flexible tail such that it provides a stable support for the item holder. When configuring the flexible tail, the user is able to account for the surface on which the item holder will rest and precisely orient the tail in a manner that provides secure position on uneven or sloped surfaces. Once the flexible tail is accurately configured, the item holding device is placed on the surface. If additional positioning is required, the item holding device can be precisely positioned by adjusting the angle of the container body.

BRIEF DESCRIPTION OF THE DRAWINGS

These and other features, aspects and advantages of the present invention will become better understood with reference to the following description, appended claims, and accompanying drawings where:

DETAILED DESCRIPTION OF THE INVENTION

The present invention allows a user to hold, carry and position small articles and totable items in a convenient location. The invention is easily affixed to almost any static structure, bag or other carrying device, or surface and precisely positioned, allowing convenient placement of the items being held. The present invention comprises a container body 10 for holding items and a flexible tail 28 for connecting the item holding device 34 in a desired location and position.

Figure 1:
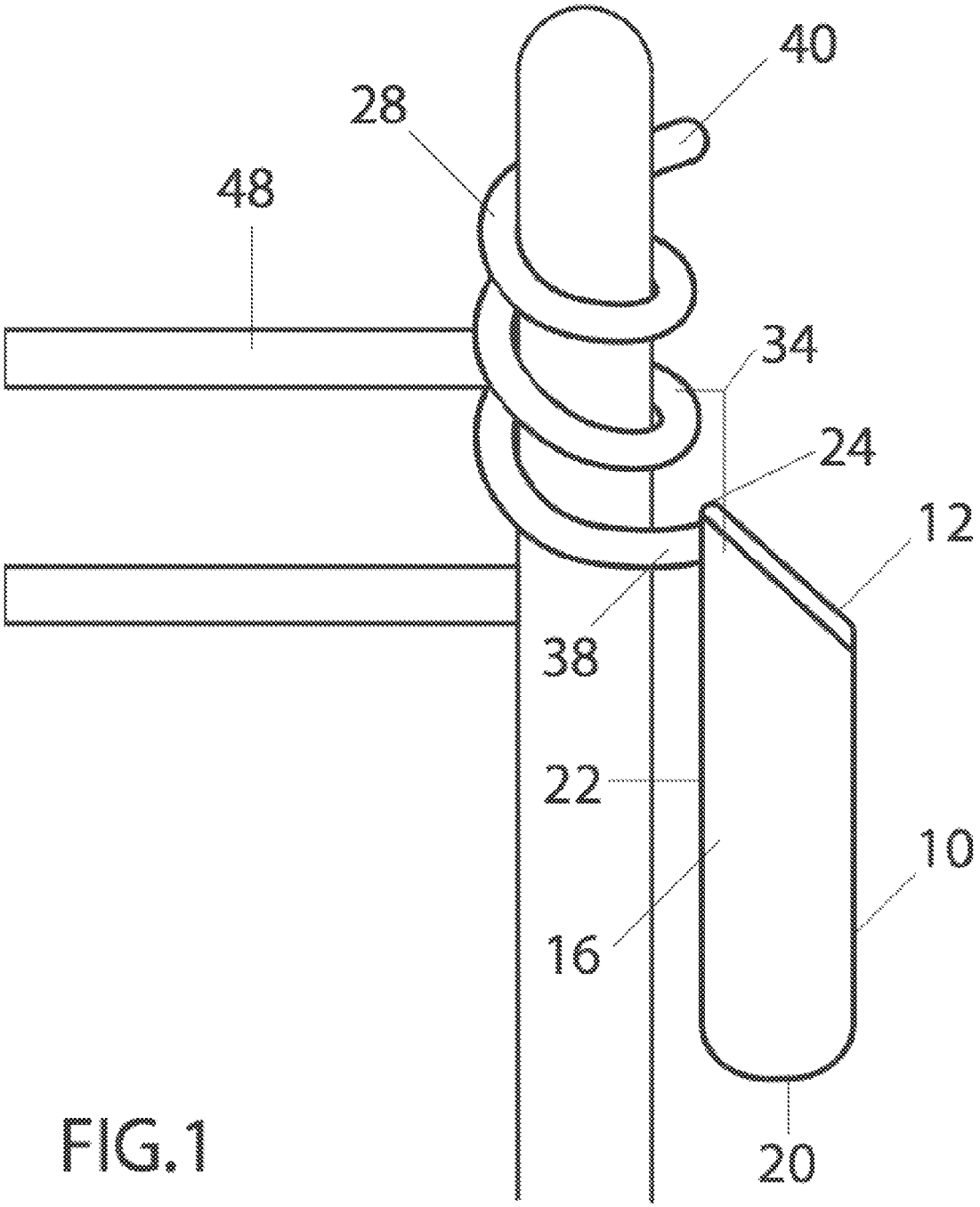
FIG. 1 shows a side view of one embodiment of the present invention attached to a chair.

Referring now to FIG. 1, an item holding device 34 according to the present invention is shown in use attached to a chair 48. The depicted embodiment of the item holding device 34 has a container body 10 comprising a single, main compartment 12, a bottom 20, a back 22, a top 24, and a cylindrical wall 16. Attached to the container body 10 is a flexible tail 28 having a container end 38 and a terminating end 40. The flexible tail 28 is shown wrapped around the back of a chair 48. The walls of the container body are vertical, like a cup, which allows objects to be securely placed within.

In alternative embodiments, the container body 10 may have various wall heights. For example, short walls with a wide bottom make the container body 10 more horizontal, like a bowl, which is advantageous for holding small items that would be difficult to retrieve from a deep compartment. Similarly, in some embodiments, the container body 10 may have one or more compartment openings, which can be placed anywhere including at the top 24, bottom 20, or cylindrical wall 16 of the container body 10. The location of the opening or openings is determined by the desired application. For instance, the opening may be placed on the bottom 20 of the container body 10 when the invention is intended for use as a dispensing device for such items as disposable cups, tissues, or golf balls. Additionally, the container body 10 may have an open or partially open bottom 20 so that objects, such as a cone or tapered cup, may be held.

The flexible tail 28 is repositionable when sufficient force is applied, yet allows the invention to be reasonably fixed and relatively stable once configured into the desired position. The flexible tail 28 allows myriad ways to connect the item holding device 34 in a desired location, and to position the container body 10 for easy access to the items within. The flexible tail 28 may be wrapped and compressed around the desired structure or object, utilizing its ability to snugly conform to the shape of the attachment point, and using frictional forces to keep the item holding device 34 in place. Additionally, the flexible tail 28 may be wrapped around a structure or object and then twisted around itself or the container body 10 to provide a more secure connection.

As the flexible tail 28 is wrapped around a structure or object, it snugly conforms to the shape of the attachment point, creating friction between the flexible tail 28 and the structure or object to keep the item holding device 34 in place. The flexible tail 28 is adapted for retaining its shape and maintaining friction between itself and a structure or object after being attached. This permits the container body 10 to be finely positioned without overcoming the friction of the attachment, thereby preventing the item holding device 34 from sliding out of position. When finely positioning the container body 10, the majority of the flexible tail 28 remains relatively static and only the container end 38 of the flexible tail 28 and the container body 10 are moved to optimally position the device.

Alternatively, the flexible tail 28 may be formed into a simple hook of any size or any arc, thereby facilitating connections to a much wider variety of locations than a standard, static hook. In addition, the flexible tail 28 may engage a structure by weaving in and out, such as between the vinyl ribs on a beach chair or the balusters of a railing. The item holding device 34 is easily detached from the connection point by applying pressure to unwrap the flexible tail 28. Once removed, the item holding device 34 can then be reattached in a new location.

Figure 2:
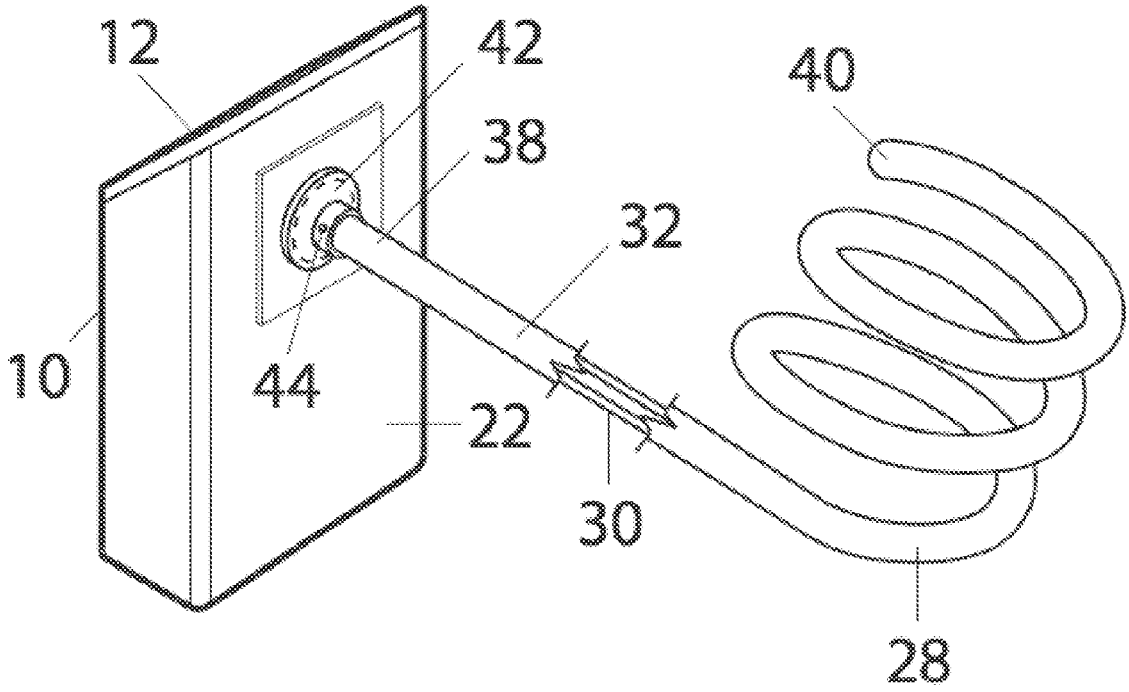
FIG. 2 shows a rear side view of one embodiment of the present invention showing details of the tail.

As shown in FIG. 2, the flexible tail 28 is comprised of a flexible core 30 covered with a foam sleeve 32. The flexible tail 28 has a container end 38 and a terminating end 40 along its length. The container end 38 of the flexible tail 28 is connected to the back wall 22 of the container body 10, by means of a collar 42 that is sewn to the back wall 22. The collar 42 holds the flexible tail 28 in place by means of a pin 44.

As depicted in FIG. 2, the flexible core 30 of the flexible tail 28 is constructed of one or more flexible wires. Alternatively, the flexible tail 28 can utilize a core constructed of repositionable plastic, multiple links having ball joints, or equivalent connections that allow adequate movement, conformity, and friction for positioning. The diameter of the flexible tail 28 and degree of friction required for binding and positioning is dependent upon the application and the weight to be supported. Where the use of a larger container body 10 is desirable, such as to hold heavy magazines, the diameter of the flexible tail 28 will be larger or the friction between the flexible tail 28 and the attachment point greater, to better support the increased weight.

The flexible core 30 of the flexible tail 28 can be left uncovered, or can be covered with a sleeve of material to improve the grip of the flexible tail 28. Examples of materials for the sleeve include foam, plastic, fabric, ridged metal or plastic conduit, a roughened dip, or other coating as known by a person of skill in the art. In other applications, a friction-reducing sleeve may be utilized for applications requiring a secure attachment, but permitting rotation around a fixed axis.

The flexible tail 28 may extend from anywhere on the container body 10 according to the desired application. However, when the flexible tail 28 is attached near the bottom 20, the container body 10 should be made out of material that holds its shape, such as reinforced fabric or molded plastic to prevent items from falling out.

Referring again to FIG. 2, the container body 10 is attached to the flexible tail 28 using a collar 42 and set pin 44 that is intended to remain in place. In alternative embodiments, the flexible tail 28 can be secured to the collar 42 in any way understood by a person of skill in the art. For example, an adhesive can be used to secure the flexible tail 28 to the collar 42 and the collar 42 itself may be adhered rather than sewn in place.

In some embodiments, the container body 10 is detachable from the flexible tail 28. The detachable container body 10 can be attached to and removed from the flexible tail 28 with a tightening means such as a removable screw, a quick-release mechanism, a hook and loop fastener, a buckle, a snap, a clamp, and other similar means. The detachable container body 10 allows the flexible tail 28 to stay wrapped in position while the container body 10 is detached and allows multiple container bodies to be used with the same tail.

Figure 3:
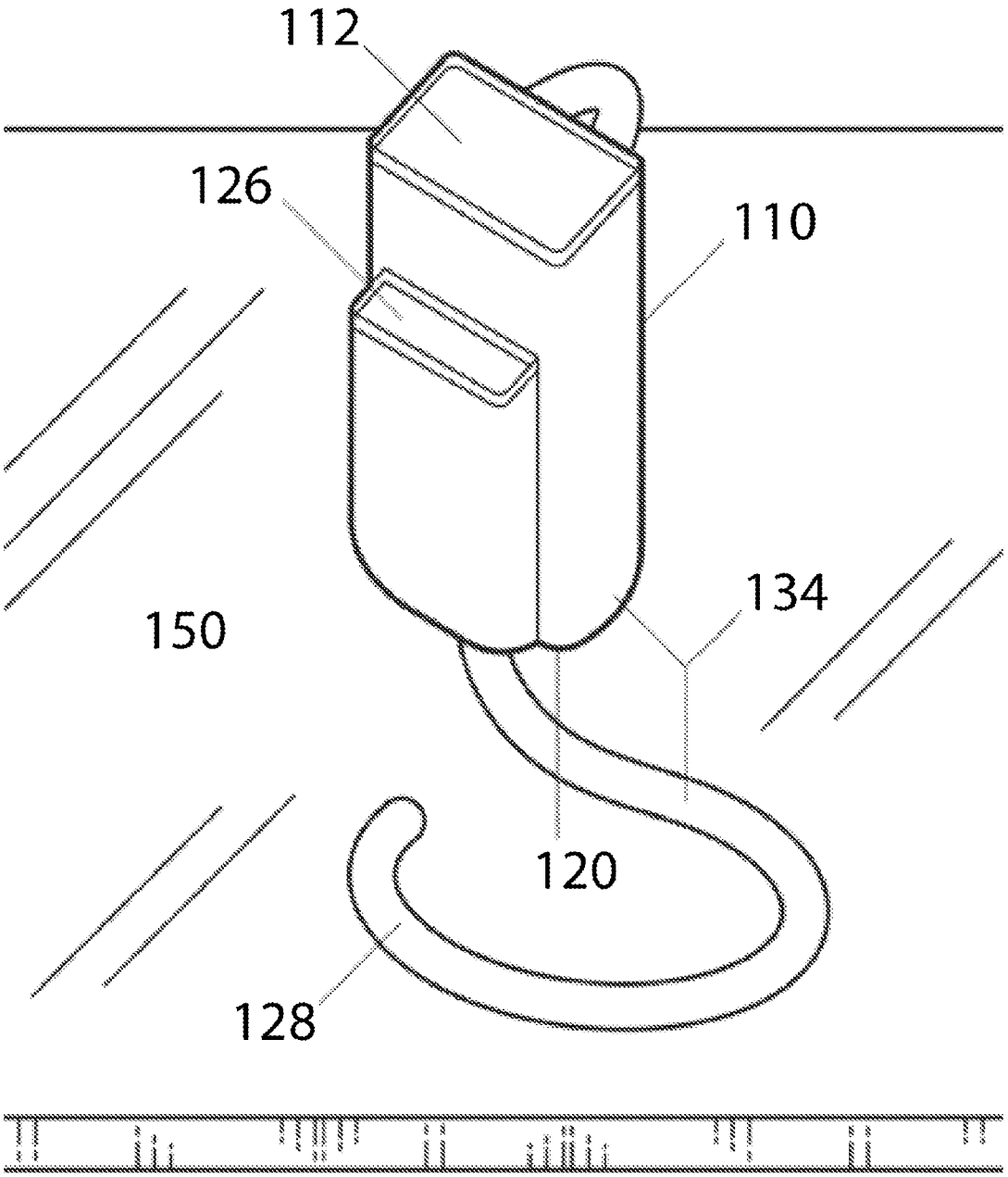
FIG. 3 shows a perspective view of one embodiment of the present invention standing independently on a flat surface.

Depicted in FIG. 3 is an item holding device 134 according to the present invention, comprising multiple compartments. The item holding device 134 is in use with the flexible tail 128 coiled below the bottom 120 of the container body 110, allowing the item holding device 134 to stand independently on a flat surface 150. The container body 110 contains a main compartment 112, as well as an auxiliary compartment 126 sharing a common dividing wall. The flexible tail 128 is covered by a high friction sleeve and is formed into a coiled foot, which allows the container to be set in a stable manner upon the surface. The adjustability of the flexible tail 128 allows the container to be made level, and the friction of the sleeve prevents the item holding device 134 from sliding when placed on surfaces that are sloped. The flexible tail 128 is easily removed from the surface and uncoiled, allowing the item holding device 134 to be repositioned as desired by the user.

With reference to the container body 10 of the item holding device 34 of the present invention, said container body 10 can include one or more compartments. Depending on the desired application, the compartments may vary in size and be arranged in a variety of ways without deviating from the spirit and scope of the present invention. Additional compartments increase the capacity of the device to hold and position totable items. When multiple compartments are utilized, material dividing the compartments may be fixed or removable. Removable dividers allow the user to customize the interior volume of the container body to better suit his or her needs.

Figure 4:
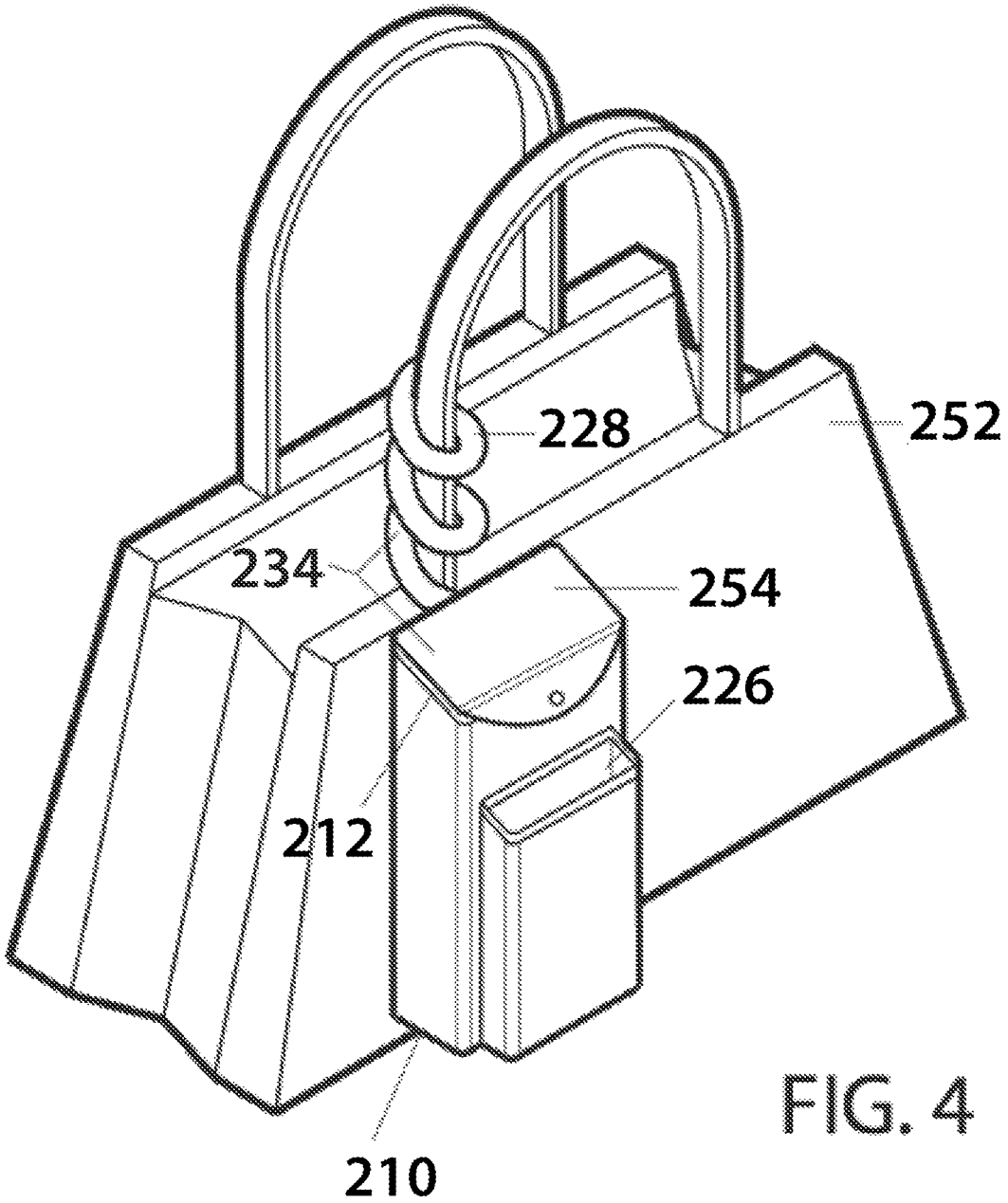
FIG. 4 shows a perspective view of one embodiment of the present invention attached to a bag.

In one embodiment of the present invention, depicted in FIG. 4, the flexible tail 228 can be configured in a manner that allows the item holding device to be bound to portable objects. The ability of the item holding device 234 to bind to backpacks and bags provides many options for transporting, holding, and positioning totable items, such as cellular phones, so the user may easily transport and access the items on the go. FIG. 4 depicts the present invention in use where the item holding device 234 is bound to a portable bag 252. The container body 210 includes a main compartment 212, having a lid 254, as well as an auxiliary compartment 226.

According to the present invention, the main compartment 212 or auxiliary compartments 226 may include a lid 254. A lid 254 is useful for applications where the item holding device 234 will be frequently moved, or where there is a danger that the items inside will fall out. The lid 254 may be secured by a variety of means including snaps, zippers, hook and loop closures, draw-strings, or buckles. Additionally, a lock may be added to the lid 254 of the item holding device 234 for security.

Figure 5:
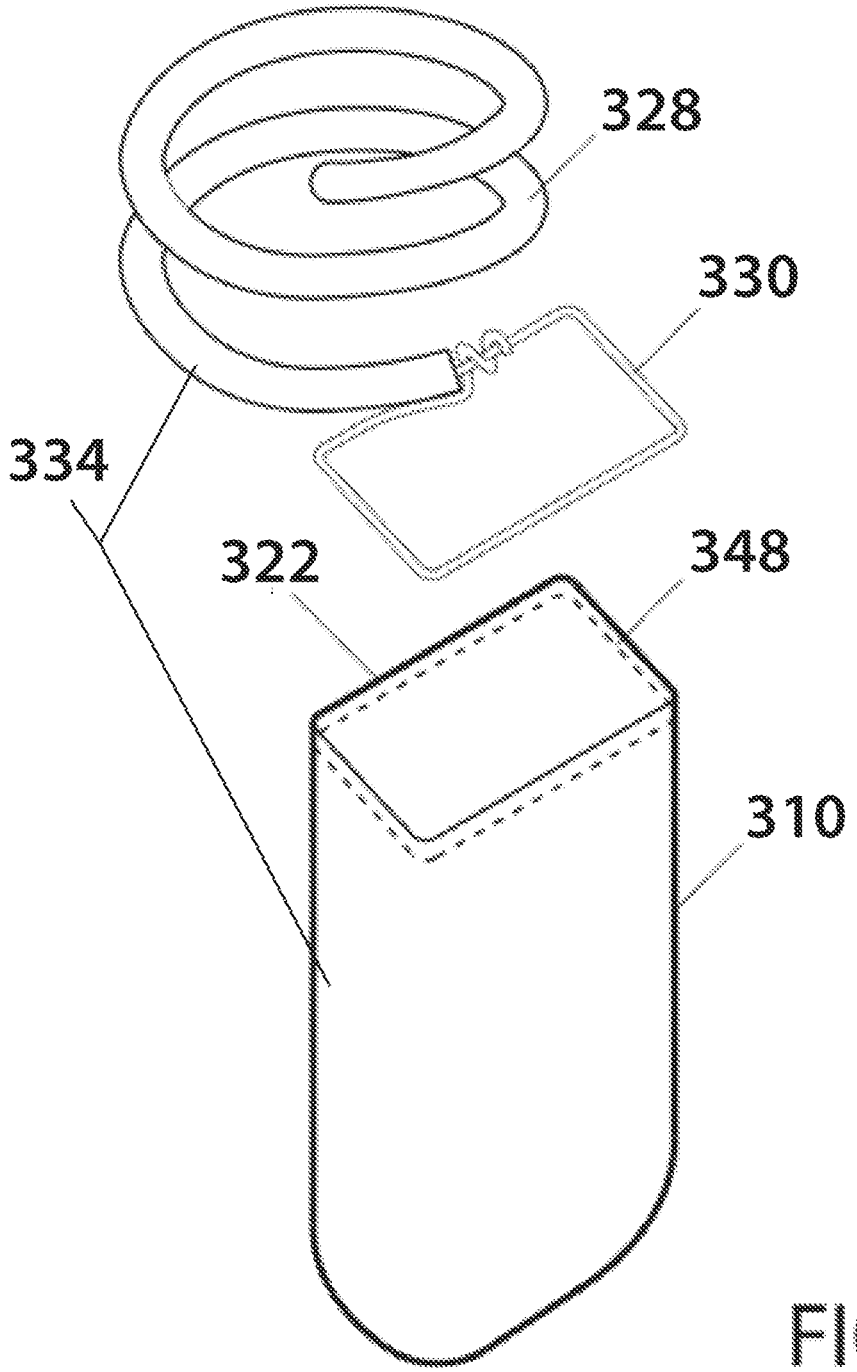
FIG. 5 shows an exploded view of one embodiment of the present invention showing a means of securing the tail to the container body.

FIG. 5 shows an item holding device 334 according to the present invention whereby the flexible tail 328 is attached to the container body 310 by sewing the flexible wire core 330, under the folded fabric to form piping 348 along the top 324. The flexible tail 328 is stripped of the sleeve material where it is sewn into the container body 310, to reduce bulk. The continuation of the flexible wire core 330 around the opening of the container body 310 allows the top 324 of the container body 310 to be shaped into an open position or instead, to be closed by means of pressing opposing sides of the opening together. This provides a quick and easy way to open and close the main compartment 312 of the item holding device 334.

Figure 6:
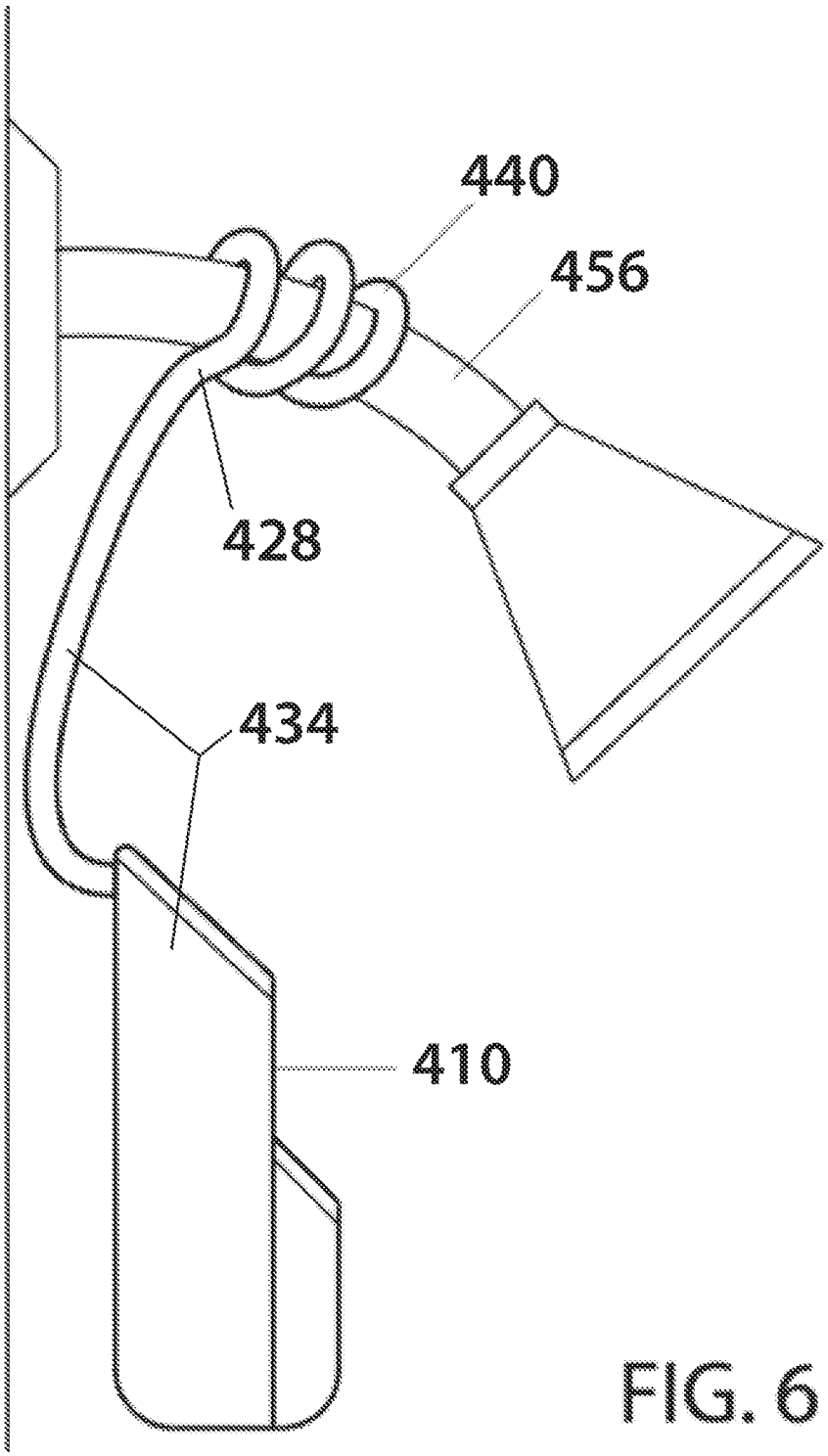
FIG. 6 shows a side view of one embodiment of the present invention attached to a shower fixture.

FIG. 6 depicts one embodiment of the item holding device 434 of the present invention in use in a shower. The terminating end 440 of the flexible tail 428 is wrapped around the shower head pipe 456 and then back onto itself to permit a secure connection and stable positioning of the container body 410. Since this embodiment of the present invention will be used in a continuously damp environment, a person of skill in the art would appreciate that the container body 410 should be made of a waterproof material such as molded plastic.

While a molded plastic may be the material of choice for wet environments such as the shower, the container body 10 of the item holding device 34 may be constructed of a wide variety of materials depending on the intended use of the item holding device 34. For example, the container body 10 may be constructed of fabrics such as cloth, synthetic or natural fibers, heavy paper, suede, leather, neoprene, EVA foam, molded or constructed plastics, fabricated wood, or metal. For benign environments almost any material may be used.

For example, the container body 10 may be constructed out of plush fabric when intended to hold items in the bedroom, while a container body 10 intended for use in the kitchen would preferably be constructed out of material that is more easily cleaned. As a further example, neoprene may be utilized for the container body 10 when the device is intended to hold cold beverage cans.

In addition to being made to accommodate different conditions, the item holding device 34 may be constructed in a specific shape to resemble a variety of recognizable forms such as monkeys, frogs, kangaroos, snakes, opossums, dragons, or tigers, as well as inanimate objects. Additionally, the container body 10 and flexible tail 28 may be ornamented with colors, prints, embroidery or decorations. Specialized shapes and ornamentation allow the item holding device 34 to be tailored to the aesthetic tastes and demographics of persons expected to utilize the invention.

Figure 7:
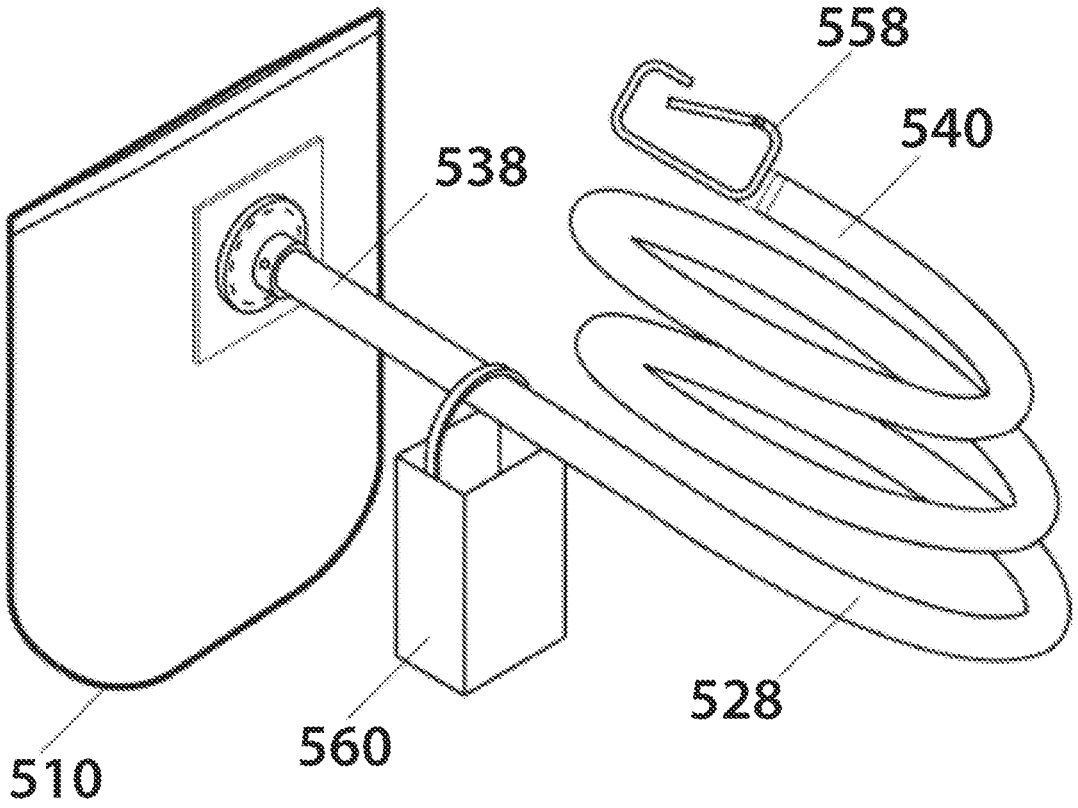
FIG. 7 shows a rear side view of one embodiment of the present invention with an additional holding device, and a clasp on the terminating end of the tail.

FIG. 7 shows one embodiment of the present invention, which includes a container body 510 and a flexible tail 528 with a container end 538 and a terminating end 540. A clasp 558 at the terminating end 540 of the flexible tail 528 functions as a fastening mechanism. An additional holding device 560 is threaded on the tail 528 to be positioned at the container end 538 of the tail 528 near the container body 510.

In addition to the clasp 558 at the terminating end 540 of the flexible tail 528, a person of skill in the art will appreciate that alternative fastening mechanisms may be utilized along the length of the tail to fit desired applications. For example, friction-fittings, buckles, snaps, magnetic snaps, clips, and hook and loop style closures may all be utilized to secure the flexible tail 528 in a desired configuration. The fastening mechanism allows the tail to be fastened back to the container to form one or more loops, which increases the security of the attachment. Alternatively, fastening mechanisms, such as the clip 558, can provide increased holding strength by allowing the flexible tail 528 to be attached directly to the structure or object, in addition to wrapping the flexible tail 528 at the attachment point.

Figure 8:
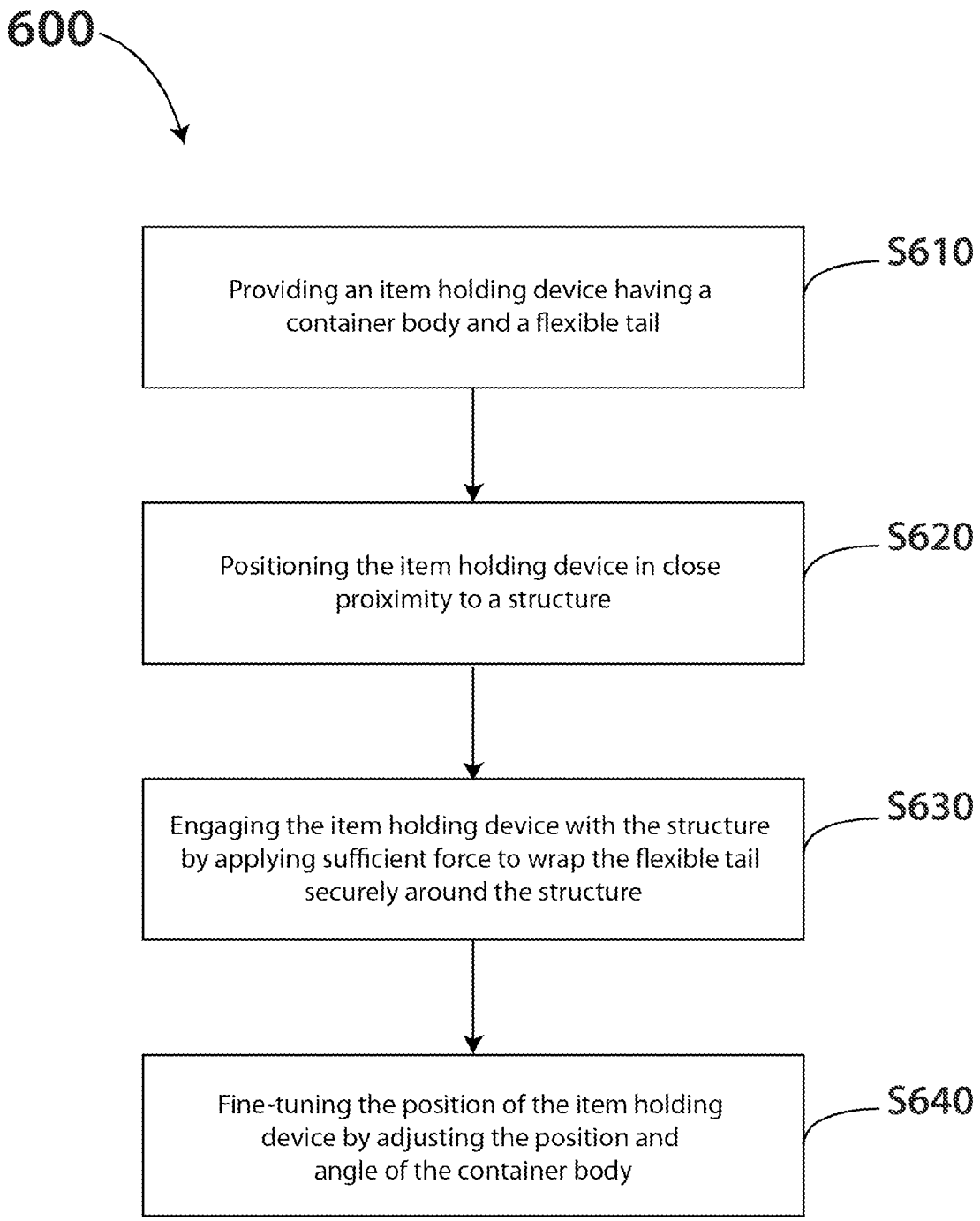
FIG. 8 shows the steps of one method of the present invention.

Turning now to FIG. 8, one embodiment of the method 600 of the present invention is depicted. A first step S610 comprises providing an item holding device 34 and a second step S620 comprises positioning the item holding device 34 in close proximity to a structure such as a post, a railing, a lamp shaft, a showerhead pipe, a rearview mirror in an automobile or a handle or strap on a bag or backpack. Once the item holding device 34 has been placed in close proximity to the structure, a third step S630 comprises engaging the item holding device 34 with the structure by applying sufficient force to wrap the flexible tail 28 securely around the structure. As illustrated in FIG. 1, the flexible tail 28 can be wrapped around a structure multiple times to increase the frictional forces and decrease the likelihood that the item holding device 34 will shift during use. In the embodiment depicted in FIG. 7, the user would also attach the clasp 558 to the flexible tail 528 or the container body 510 for additional support. A fourth step S640 comprises fine-tuning the position of the item holding device 34 by adjusting the position and angle of the container body 10.

Figure 9:
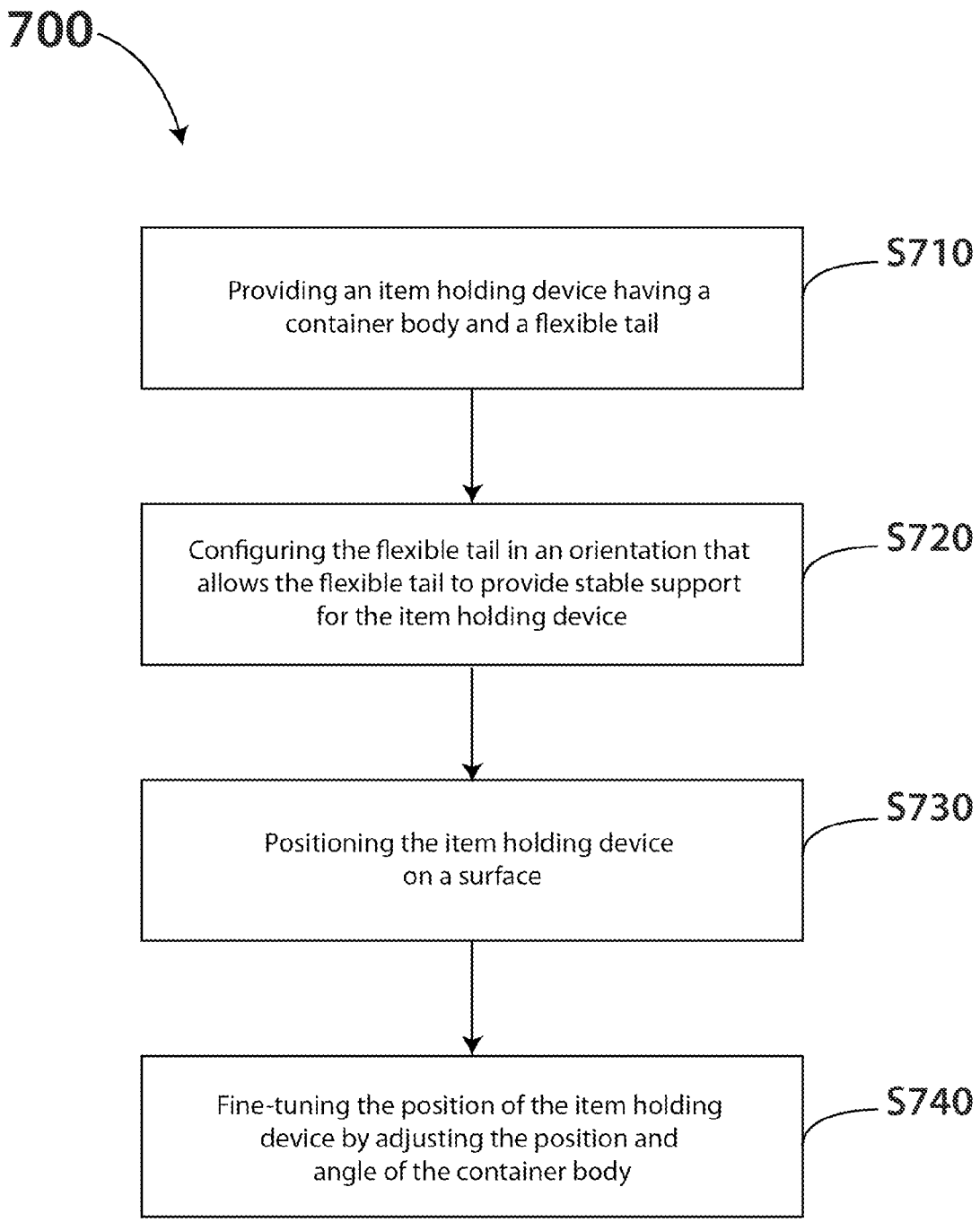
FIG. 9 shows the steps of one method of the present invention.

Turning to FIG. 9, another embodiment of the method 700 of the present invention is depicted. A first step S710 comprises providing an item holding device 34. A second step S720 comprises configuring the flexible tail 28 in an orientation that allows the flexible tail 28 to provide stable support for the item holding device. As depicted in FIG. 3, the flexible tail may be coiled to increase contact area with a surface. Where the target surface is not uniform, the flexible tail 28 can be configured in a manner that conforms to the precise contours of the surface, thereby improving stability. Once the flexible tail 28 has been configured for the target surface, a third step S730 comprises positioning the item holding device 34 on the surface in a location desirable to the user. A fourth step S640 comprises fine-tuning the position of the item holding device 34 by adjusting the position and angle of the container body 10.

It is noted that the foregoing examples have been provided merely for the purpose of explanation and are in no way to be construed as limiting of the present invention. While the present invention has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. An item holding device comprising:

a. a container body having one or more compartments adapted for holding totable items;

b. a lid or cover on the one or more compartments of the container body;

c. a flexible tail having a container body end directly attached to the container body and a terminating end, wherein at least a substantial portion of the container body is external to the flexible tail;

d. said flexible tail possessing sufficient flexibility to wrap and conform to an object and enough rigidity to maintain its form once configured, thereby holding the container body in a substantially stable position.

2. The item holding device of claim 1 wherein the container body is constructed of a material from the group consisting of: fabrics; heavy paper; suede; leather; neoprene; EVA foam; molded or constructed plastics; fabricated wood; and metal.

3. The item holding device of claim 1 wherein the flexible tail is constructed of one or more metal wires.

4. The item holding device of claim 1 wherein the entire container body is external to the flexible tail.

5. The item holding device of claim 1 wherein the tail is attached to the container body using a collar.

6. The item holding device of claim 1 wherein the flexible tail is attached to the container body with a removable screw, a quick-release mechanism, a hook and loop fastener, a buckle, a snap or a clamp.

7. The item holding device of claim 1 further comprising a sleeve covering the flexible tail.

8. The item holding device of claim 7 further wherein the sleeve material is selected from the group consisting of: foam; plastic; fabric; and roughened dip.

9. The item holding device of claim 1 further comprising an auxiliary fastening mechanism on the flexible tail.

10. The item holding device of claim 9 wherein the auxiliary fastening mechanism is a clasp.

11. A method of using an item holding device comprising:

a. providing an item holding device comprising:

i. a container body having one or more compartments adapted for holding totable items;

ii. a flexible tail having a container body end directly attached to the container body and a terminating end, wherein at least a substantial portion of the container body is external to the flexible tail;

iii. said flexible tail possessing sufficient flexibility to wrap and conform to an object and enough rigidity to maintain its form once configured, thereby holding the container body in a substantially stable position;

b. positioning the item holding device in close proximity to a structure;

c. engaging the item holding device with the structure by applying sufficient force to wrap the flexible tail securely around the structure;

d. fine-tuning the position of the item holding device by adjusting the position and angle of the container body.

12. The method of claim 11 wherein the flexible tail is constructed of one or more metal wires.

13. The method of claim 11 wherein the item holding device further comprises a sleeve covering the flexible tail.

14. The method of claim 11 wherein the item holding device further comprises an auxiliary fastening mechanism on the flexible tail.

15. The method of claim 11 wherein the tail is attached to the contained body using a collar.

16. An item holding device comprising:

a. a container body having one or more compartments adapted for holding totable items;

b. a flexible tail having a container body end directly attached to the container body and a terminating end, wherein at least a substantial portion of the container body is external to the flexible tail;

c. wherein the flexible tail is constructed of one or more metal wires;

d. said flexible tail possessing sufficient flexibility to wrap and conform to an object and enough rigidity to maintain its form once configured, thereby holding the container body in a substantially stable position.

17. The item holding device of claim 16 wherein the container body is constructed of a material from the group consisting of: fabrics; heavy paper; suede; leather; neoprene; EVA foam; molded or constructed plastics; fabricated wood; and metal.

18. The item holding device of claim 16 further comprising a sleeve covering the flexible tail.

19. The item holding device of claim 16 further comprising an auxiliary fastening mechanism on the flexible tail.

20. The item holding device of claim 16 wherein the tail is attached to the container body using a collar.

* * * * *